US005558555A

United States Patent [19]

Kennedy

[11] Patent Number: 5,558,555

[45] Date of Patent: Sep. 24, 1996

[54] SKATING DOLL PLATFORM

[76] Inventor: Melvin Kennedy, 825 Marbella La., Lantana, Fla. 33462

[21] Appl. No.: 528,477

[22] Filed: Sep. 14, 1995

[51] Int. Cl.[6] ..... A63H 3/20; A63H 11/00

[52] U.S. Cl. ..... 446/359; 446/352; 446/330

[58] Field of Search ..... 446/359, 360, 446/366, 358, 357, 353, 352, 333, 332, 331, 330, 289, 290, 293, 279, 268, 280, 288, 287

[56] References Cited

U.S. PATENT DOCUMENTS

| | | | |
|---|---|---|---|
| 773,169 | 10/1904 | Strenitz | 446/359 |
| 1,364,388 | 1/1921 | Lemke | 446/359 |
| 3,675,362 | 7/1972 | de Gelder et al. | 446/366 X |
| 4,141,176 | 2/1979 | Flicker et al. | 446/359 X |
| 4,183,172 | 1/1980 | Lewis et al. | 446/352 |
| 5,328,400 | 7/1994 | Bass | 446/268 X |
| 5,458,523 | 10/1995 | Aoki et al. | 446/333 X |

FOREIGN PATENT DOCUMENTS

| | | | |
|---|---|---|---|
| 12801 | 6/1902 | United Kingdom | 446/359 |

*Primary Examiner*—Mickey Yu
*Assistant Examiner*—D. Neal Muir
*Attorney, Agent, or Firm*—Michael Ebert

[57] ABSTRACT

A platform for animating a doll mounted thereon, the platform being provided with a base having a circular well recessed in its underside. Anchored on the base is an upright bearing in which is received a shaft whose upper end projects above the bearing and is clamped to one leg of the doll to support it above the base. The lower end of the shaft projects into the well and is joined to an actuator having an eccentric tip which frictionally engages the horizontal play surface on which the platform is placed. When a player pushes the platform back and forth along this surface the tip is then caused to sweep in a circular path within the well and in doing so to cause the shaft and the doll clamped thereto to rotate. Thus as the platform is pushed, the advancing doll rotates to execute a pirouetting dance movement.

9 Claims, 3 Drawing Sheets

SKATING DOLL PLATFORM

BACKGROUND OF INVENTION

1. Field of Invention

This invention relates generally to devices for animating a doll, and more particularly to a platform adapted to support a doll in an upright position and for causing the doll to rotate when the platform is manually pushed along a horizontal play surface whereby the doll then appears to be dancing.

2. Status of Prior Art

A typical doll is a small figure resembling a human being, such as an infant, a child or an adult. The doll which is surely the most popular of all toys for girls, can trace its history back to ancient times, for Egypt, Greece and Rome have left well-preserved dolls formed of clay and other durable materials.

Doll technology has now reached a high level of sophistication, for dolls are now available that are articulated, bendable or stretchable whereby a player manipulating the doll can cause it to assume any desired posture. A doll intended for a child is not just a plaything, for the doll serves as a surrogate for a living being, and by playing with the doll, the child learns to relate to the being.

Thus in the case of the renowned Cabbage Patch Kids baby doll, a child who acquires this doll and handles it as if it were a living baby must also sign adoption papers and give the doll a name, just as if it were born to the child.

An activity that holds great fascination for children is dancing, and children therefore seek to make their otherwise inanimate doll appear to be dancing. To render a doll danceable, the Jupiter U.S. Pat. No. 2,754,121 provides a large doll whose size approaches that of a small child, the doll having articulated arms and legs and a pair of feet provided with straps to receive the feet of a child dancing with the doll.

In Jupiter, the doll and child together form a ballroom couple, one hand of the child holding the corresponding hand of the doll, the other hand of the child holding the doll about its waist while the other hand of the doll rests on the shoulder of the child. Since the feet of the doll are linked to those of the child, and the child and doll are holding each other, the child and doll then appear to be dancing as a couple.

The present invention also seeks to make a doll dance, but not by having the child dance with the doll as in the Jupiter patent, for then the doll's size must be close to that of the child holding it, but by having the doll dance on a platform or stage when the platform is manually pushed along a table or other horizontal play surface.

Of particular prior art interest is the Lemke U.S. Pat. No. 1,364,388 which shows a toy soldier mounted on a platform, a pin joined to the underside of the soldier and extending downwardly therefrom having a bent tip which engages the play surface in which the platform is placed. When the platform is dragged along this surface, the tip of the finger then sweepes a circular path to rotate the soldier attached to the pin and thereby simulate a military movement.

In the Kimodo U.S. Pat. No. 4,674,988, a doll mounted above a platform is caused to twirl to simulate dancing. For this purpose use is made of a thumb-operated flywheel operatively coupled to the doll. In the Kimura U.S. Pat. No. 4,040,206 the doll is turned about an axle rotated by a hand-crank operated mechanism. The Gunther et al. U.S. Pat. No. 3,643,374 and the Yeu U.S. Pat. No. 4,674,764 shows platform mounted dolls animated by means of battery-powered motors.

SUMMARY OF INVENTION

In view of the foregoing the main object of this invention is to provide a platform adapted to animate a doll mounted thereon when the platform is pushed along a horizontal play surface.

More particularly, an object of this invention is to provide a platform adapted to support a doll in an upright position and to cause the doll to rotate on the platform when the platform is manually shifted along a horizontal play surface whereby the doll then appears to be dancing. Thus as the platform-mounted doll is advancing along the play surface it is at the same time pirouetting.

Also an object of this invention is to provide a platform of the above type which operates efficiently, is durable and can be mass-produced at relatively low cost.

Briefly stated, these objects are attained in a platform for animating a doll mounted thereon, the platform being provided with a base having a circular well recessed in its underside. Anchored on the base is an upright bearing in which is received a shaft whose upper end projects above the bearing and is clamped to one leg of the doll to support it above the base. The lower end of the shaft projects into the well and is joined to an actuator having an eccentric tip which frictionally engages the horizontal play surfaces on which the platform is placed.

When a player pushes the platform back and forth along this surface the tip is then caused to sweep in a circular path within the well and in doing so to cause the shaft and the doll clamped thereto to rotate. Thus as the platform is pushed, the advancing doll rotates to execute a pirouetting dance movement.

BRIEF DESCRIPTION OF DRAWINGS

For a better understanding of the invention reference is made to the detailed description to follow which is to be read in conjunction with the accompanying drawings in which.

DETAILED DESCRIPTION OF INVENTION

First Embodiment

Figure 1:
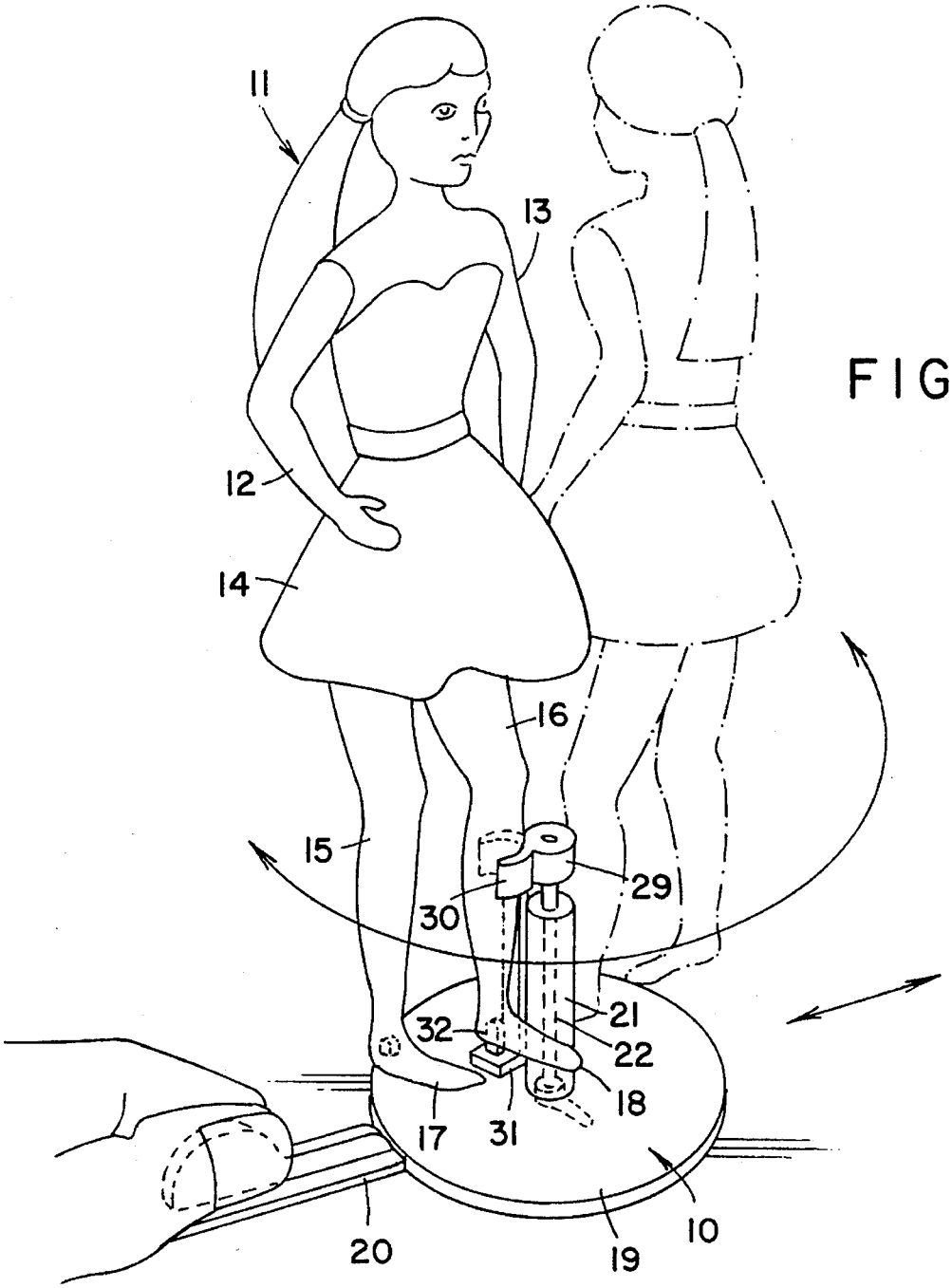
FIG. 1 is a perspective view of a fist embodiment of a doll-animating platform in accordance with the invention.
Figure 2:
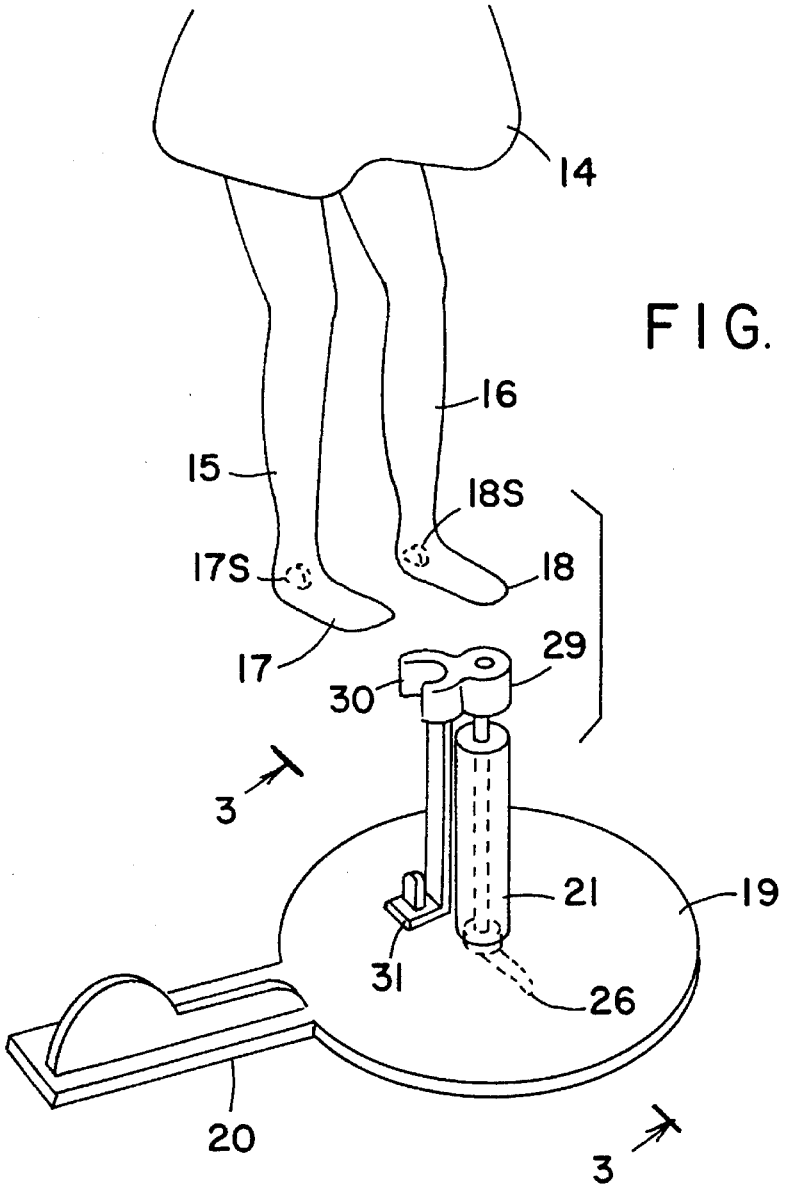
FIG. 2 illustrates the manner in which a doll is mounted on the platform.
Figure 3:
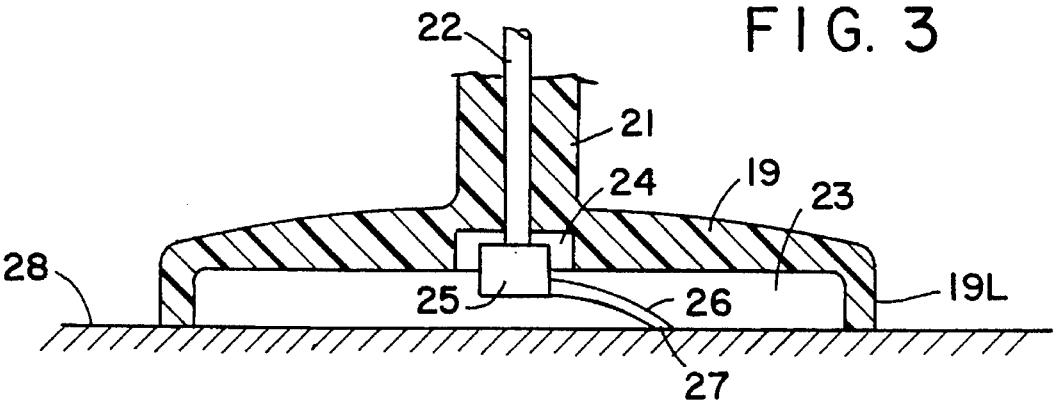
FIG. 3 is a section taken through the platform in the transverse plane indicated by lines 3—3 in FIG. 2.

Referring now to FIGS. 1 to 3, shown in these figures is a platform in accordance with the invention generally identified by reference numeral 10. Platform 10 serves as a stage for a doll generally identified by numeral 11. This doll may be any commercially available doll whose dimensions are such that it can be mounted on the stage and animated thereby.

Doll 11 which may be molded of synthetic plastic material is provided with bendable arms 12 and 13 joined to the shoulders of the doll. Because the arms are bendable, they may be made to assume any desired position, and need not therefore be made to extend downwardly toward a flared skirt 14 attached to the waist of the doll, as shown in FIG. 1.

Also provided is a pair of bendable legs 15 and 16 terminating respectively in feet 17 and 18. Each foot, at its leg junction is provided with a female socket (17S and 18S) whose function will be later explained.

Platform 10 which is molded or otherwise formed of synthetic plastic material, such as PVC or polyethylene, includes a circular base 19 and a handle 20 integral with the base and extending radially from its periphery. Anchored at the center of base 19 is an upright cylindrical bearing 21 through which extends a spindle or shaft 22 which is somewhat longer than the bearing. Shaft 22 is rotatable within the bearing and is also axially slidable therein.

Figure 5:
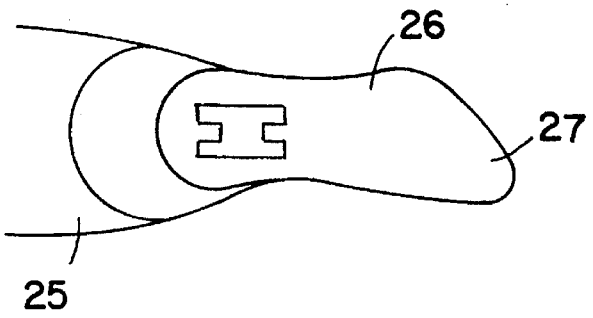
FIG. 5 is a separate view of the finger.
Figure 6:
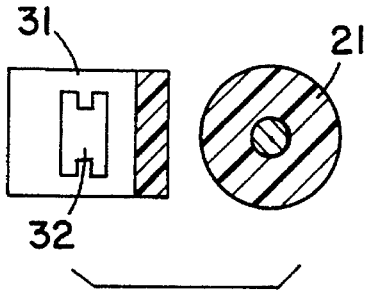
FIG. 6 is a section taken through the bearing anchored on the platform and through a foot rest for a foot of the doll.

As best seen in FIGS. 3 and 5 the underside of base 19 is recessed to define a circular well 23 surrounded by an annular lip 19L. Formed in well 23 is a central pit 24 which communicates with the bore of bearing 21. The lower end of shaft 22 projects out of bearing 21 into pit 24 which communicates with the bore of the bearing. The lower end of shaft 22 is joined to a cylindrical hub 25. Mounted on hub 25 and extending radially therefrom is a flexible finger 26 having a forwardly bent tip 27. Tip 27 frictionally engages the horizontal play surface 28 on which the platform is placed. This play surface may be a table, a floor, or whatever other surface on which a child places the platform to animate a doll mounted thereon.

The upper end of shaft 22 which projects above upright bearing 21 is joined to a small hub 29. Attached to one side of hub 29 is a leg clamp 30 formed by a split cylindrical shell defining a pair of resilient jaws to engage the leg of the doll 11 mounted on the platform, as shown in FIG. 1. Depending from clamp 30 is a foot rest 31 provided with a male plug 32.

To mount doll 11 on the platform so that it is securely held upright, leg 16 of the doll is engaged by clamp 30 as shown in FIGS. 1 and 2, the foot 18 of this leg lying on foot rest 31 so that the male plug 32 is then inserted in female socket 18S formed in the foot, thereby securely holding the leg in place.

The other leg 15 of the doll is unsecured and may therefore be bent to assume any desired position. Thus while leg 15 is shown in FIG. 1 as extending downwardly toward base 19 of the platform, it may be bent outwardly by a player to cause the doll to appear to be executing a dance step. And while the arms 12 and 13 of the doll are shown as being directed toward skirt 14, they may be outwardly extended or otherwise positioned by the player.

Operation

To animate doll 11, it is mounted on platform 10 in the manner shown in FIG. 1, one leg of the doll be gripped by clamp 30 to hold the doll upright. Shaft 22 to which clamp 30 is coupled is longer than the bearing 21 through which it extends and is slidable thereon. Hence the weight of doll 11 applies a downward pressure on shaft 22 and this acts to urge the tip 27 of finger 26 against the play surface on which the platform is placed.

Figure 4:
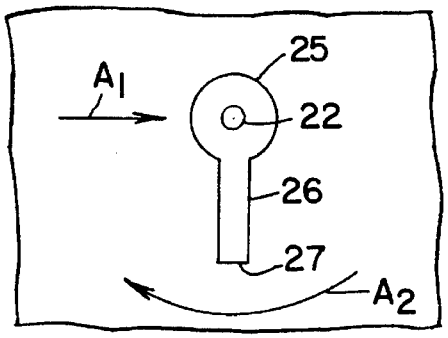
FIG. 4 shows the underside of the base of the platform and indicates how shifting the platform causes a finger to sweep in a circular path.

When, therefore, a player grasps handle 20 and pushes the platform along the play surface back and forth in an orbital path, as indicated by arrow $A_1$ in FIG. 4, this movement causes finger 26 whose tip is urged against the play surface to sweep in a circular path within the underside well of the platform, as indicated by arrow $A_2$ in FIG. 4.

Since finger 26 is joined to shaft 22, when it sweeps within a circular path, this causes shaft 22 to rotate and in doing so to cause doll 11 clamped to the shaft to move in a circular orbit about shaft 22 as shown in FIG. 1.

If the back and forth movement of the platform is in a clockwise orbital path, the shaft will then be caused to rotate in a clockwise direction, but when the back and forth movement is in a counterclockwise orbital path, the shaft then rotates counterclockwise. Should the platform be pushed straight forward, that the finger tip will not sweep in a circular path but will orient the shaft to which it is coupled to cause the doll to face forward on the platform and should the platform movement be reversed to go straight back, the doll will then reverse its position on the platform.

Hence by pushing the platform along the horizontal play surface in various directions, the doll is caused to spin on the platform or change its orientation on the platform and thereby appear to be pirouetting or to be executing other dance movements.

Second Embodiment

The platform illustrated in FIGS. 1 to 6 includes as the actuator for shaft 22 to which the doll is clamped a finger extending radially from the lower end of the shaft the tip of the finger is therefore eccentric with respect to the axis of the shaft.

Figure 7:
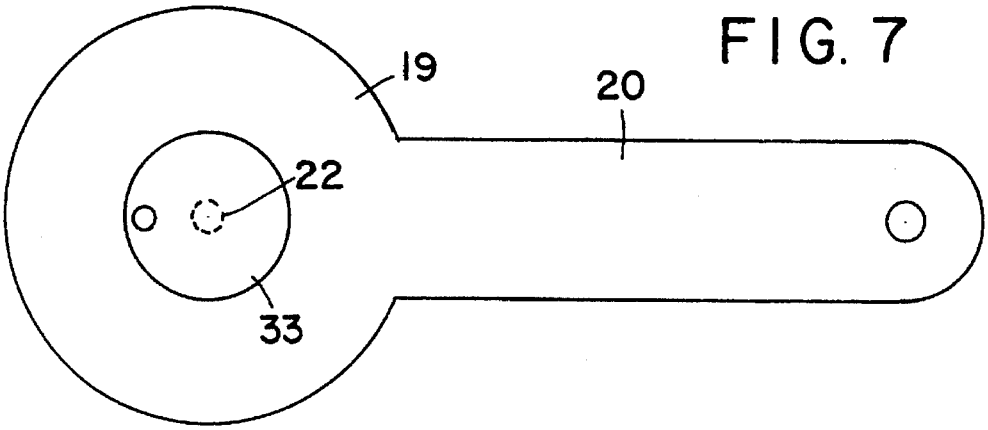
FIG. 7 is a bottom view of a second embodiment of the platform.
Figure 8:
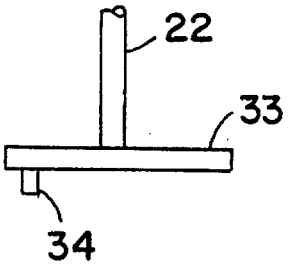
FIG. 8 is a section taken through the actuator included in the platform.

In the embodiment shown in FIGS. 7 and 8, instead of a shaft actuator in the form of a finger, attached to the lower end of shaft 22 which extends into a circular well in the underside of platform 19 is an actuator disc 33. Anchored on this disc is a projecting pin or tip 34 which is eccentric with respect to the axis of the shaft.

The tip is preferably formed of resilient material so that when the platform is pushed on a surface, the tip is then dragged and does not slip.

When the platform is placed on a horizontal playing surface, tip 34 then frictionally engages this surface and when the platform is pushed along this surface in the manner previously described, the tip sweeps in a circular path within the well, causing the shaft to rotate and causing the doll clamped to the shaft to dance on the platform.

While there has been shown and disclosed preferred embodiments of the invention, it will be appreciated that many changes may be made therein without departing from the spirit of the invention.

I claim:

1. A platform acting as a stage to animate a doll having a given weight mounted thereon, said doll having a pair of legs terminating in feet, said platform comprising:

A. a base functioning as a stage and an underside well recessed therein;

B. an upright tubular bearing mounted on the platform;

C. a spindle extending through the tubular bearing loosely thereby being slidable and rotatable therein; said spindle having an upper end projecting above the bearing and a lower end projecting into the well;

D. an actuator joined to the lower end of the spindle, and provided with an eccentric projecting tip which when the platform is placed on a horizontal play surface then frictionally engages this surface; and E. means to clamp one leg of the doll to the upper end of the spindle to support said doll above the platform, the weight of the doll applying a downward pressure on the slidable spindle to urge said tip against said play surface whereby when the platform is manually pushed along said surface, the tip then sweeps in a circular path in said well and turns said spindle to rotate said doll.

2. A platform as set forth in claim 1, in which said base and said well are circular and said bearing is anchored at the center of a base.

3. A platform as set forth in claim 1, in which the actuator is formed by a flexible finger extending radially from the spindle and terminating in said tip which is bent to engage said surface.

4. A platform as set forth in claim 1, in which the actuator is formed by a disc having an eccentric tip anchored on said disc.

5. A platform as set forth in claim 1, in which the means to clamp one leg of the doll is formed by a split shell forming a clamp.

6. A platform as set forth in claim 5, further including a foot rest depending from the clamp to receive the foot of the leg held in the clamp.

7. A platform as set forth in claim 6, in which the foot rest is provided with a male plug which is received in a female socket formed in said foot.

8. A platform as set forth in claim 1, in which the base and bearing are integral with each other and are molded of synthetic plastic material.

9. A platform as set forth in claim 4, in which the tip is formed of resilient material which drags on said surface.

* * * * *